United States Patent [19]

Garaty

[11] 3,948,145

[45] Apr. 6, 1976

[54] FLUID CONTROL MECHANISM

[75] Inventor: John Francis Garaty, Fairy Meadow, Australia

[73] Assignee: Australian Iron & Steel Pty. Limited, Port Kembla, Australia

[22] Filed: Mar. 28, 1974

[21] Appl. No.: 455,769

[30] Foreign Application Priority Data

Apr. 2, 1973 Australia ..... 2840/73

[52] U.S. Cl. ..... 91/61; 91/412; 137/101

[51] Int. Cl.[2] ..... F15B 11/20

[58] Field of Search ..... 91/412, 444; 137/101, 118

[56] References Cited

UNITED STATES PATENTS

| | | | |
|---|---|---|---|
| 2,462,983 | 3/1949 | MacDuff et al. | 137/101 X |
| 2,804,751 | 9/1957 | Schroeder | 91/412 X |
| 2,995,141 | 8/1961 | Hipp | 137/101 |
| R24,892 | 10/1960 | Banker | 137/101 |

*Primary Examiner*—Edgar W. Geoghegan

*Attorney, Agent, or Firm*—Ladas, Parry, Von Gehr, Goldsmith & Deschamps

[57] ABSTRACT

This invention relates to a fluid control system adapted to be used in a rock or roof drill to control the drill feed rate automatically with respect to the resistance of the strata material to drill penetration. The system comprises a priority flow divider which functions to divide a fluid supply source into two distinct flow paths and to control the volumetric flow rate of one flow path independent of the demand from either flow path, a first manually operated shut off valve controlling the flow of fluid through one of said flow paths to a drill motor and the second control valve controlling the direction of feed of said drill.

11 Claims, 7 Drawing Figures

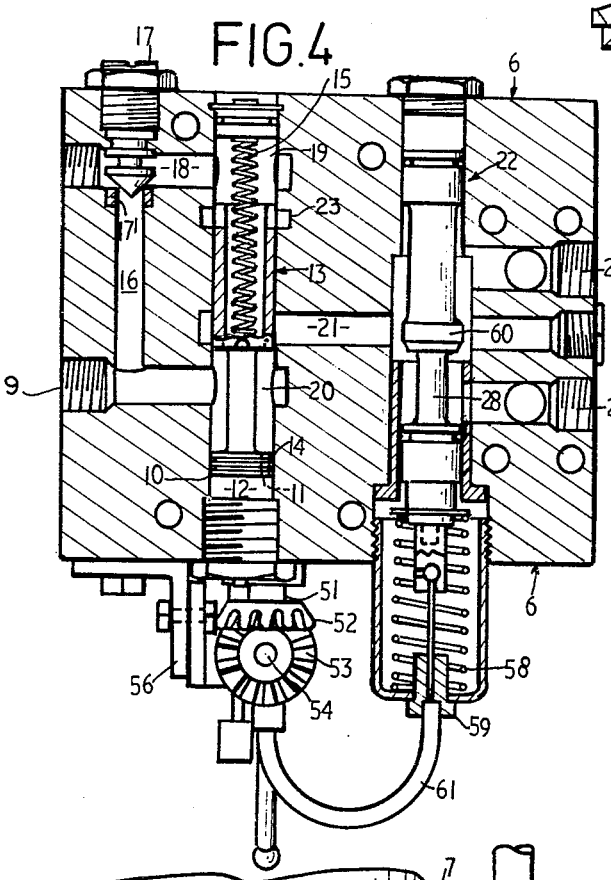
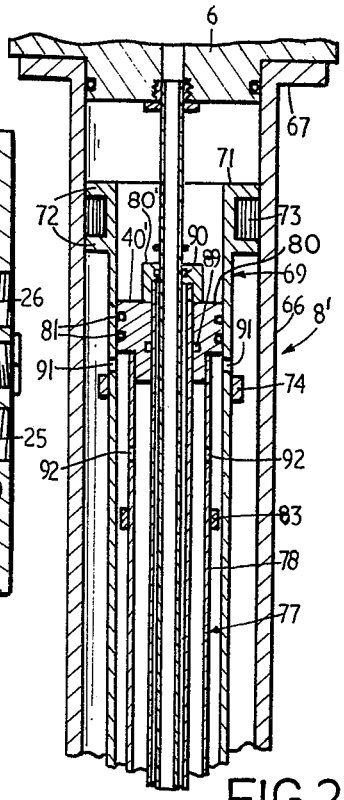
FIG.2
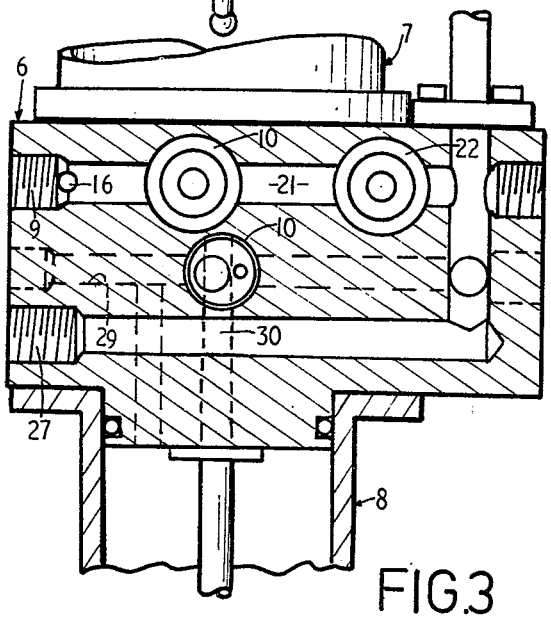
FIG.3
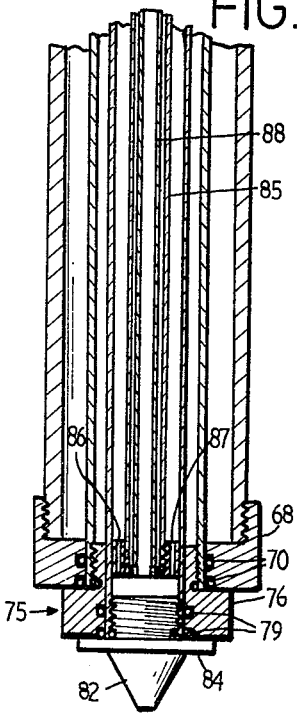

FLUID CONTROL MECHANISM

BACKGROUND

This invention relates to the field of hydromechanical control systems and more particularly to a hydromechanical control mechanism having the capability of supplying fluid to a plurality of apparatuses from a single fluid source whereby synchronized control of the apparatuses may be achieved with respect to their individual demands on the single fluid supply source.

In the mining industry it is often required that a hole be drilled in the roof of a tunnel so that the roof may be bolted to prevent collapse. Heretofore this operation has been carried out with the aid of a manually handled jack hammer. In the confined area of the coal or ore face the noise of a jack hammer is excessive, making conditions for the operator particularly unpleasant. In addition to the aforementioned defects the present known methods of performing this function are inefficient by virtue of the fact that the operator cannot always maintain the pressure on the hammer to achieve the required penetration of the strata.

SUMMARY

The present invention provides a fluid control system which has the capability of achieving simultaneous synchronized or non-synchronized control of a plurality of fluid powered apparatuses.

An object of the invention is to provide a fluid control system which may form the basis for a rock or roof drill which is substantially free from the aforementioned defects.

In one general form the invention is a fluid control mechanism comprising a housing body, a high pressure fluid inlet passage in the body communicating with a priority flow dividing device in the body, including means compensating for fluid pressure and flow variations, said flow dividing device functioning to separate a fluid passing therethrough from the inlet passage into two volumetrically different flow paths, the first one of said flow paths being directed to a first balanced fluid control device adapted to supply a metered fluid flow to a first remote fluid powered device, and the other of said flow paths being directed to a second fluid control device adapted to supply a controlled fluid flow through one of a plurality of passages in the body to a second remote fluid powered device for functional control thereof.

DRAWINGS

Notwithstanding any other forms that may fall within its scope the invention will hereinafter be described in one preferred form by way of example only with reference to the accompanying drawings of which:

FIG. 2 is a sectional elevation of one form of hydraulic leg used in conjunction with the invention;

FIG. 3 is a view taken on line 3—3 of FIG. 1;

FIG. 4 is a view taken on line 4—4 of FIG. 1;

DESCRIPTION OF THE EMBODIMENT

The invention resides in a fluid control system which is interposed between a high pressure fluid supply source and a plurality of individual but associated fluid powered apparatuses. The basic function of the system is to divide a fluid supply into an appropriate number of flow paths, each flow path being connected to one apparatus. Additionally, the system controls the division of the fluid supply irrespective of the demands placed upon it by the apparatus. Also the system provides simplified control of the individual apparatuses.

The control system is suitable for use with a wide range of relatively dense fluids. These fluids may be corrosive or non-corrosive according to the type of material from which the internal components of the system are manufactured. For ease of description, however, the invention will be described in connection with hydraulic fluids.

There are many situations in which the invention could be utilized to control a plurality of fluid powered devices such as, for example, fluid powered motive transport systems, synchronized and non-synchronized production control equipment and shear and stress loading apparatus. Many other applications will become apparent to those skilled in the art but for ease of description the invention will hereinafter be described in conjunction with a rock or roof drill.

Figure 1:
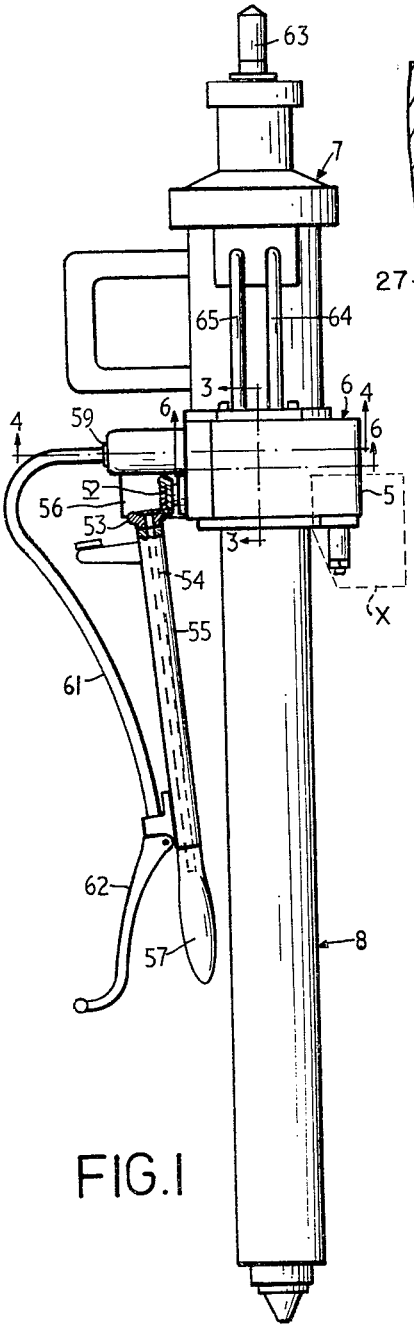
FIG. 1 is an elevation of a rock or roof drill incorporating the invention.

Referring now to the drawings, the fluid control system comprises a body represented by numeral 6 which may be constructed in any configuration according to the application to which it is put but for the purposes of the present application is rectangular in all planes. As may be seen from FIG. 1 the body 6 is interposed between a hydraulic motor 7 and a hydraulically operated leg 8, each of which may be of conventional design.

Basically, a high pressure fluid supply of about 20 gallons per minute is applied to a manifold passage 9 extending into the body 6 and communicating at a right angular placement with a second passage 10 extending through the body (FIGS. 3 and 4). Mounted in the second passage is a flow dividing valve assembly 13. This flow dividing valve assembly is in essence a pressure balanced spool 14, which is spring biased towards the junction between the fluid inlet passage 9 and the second passage 10 and includes means 11 permitting a pilot fluid supply to be fed to the end face 12 of the valve spool 14 remote from the spring 15. This pilot pressure supply performs two functions, the first of which is to assist in the balancing of the valve spool assembly 13 to prevent a hydraulic lock and the second is to move the valve spool 14 (in some circumstances) against the spring bias pressure.

Figure 7:
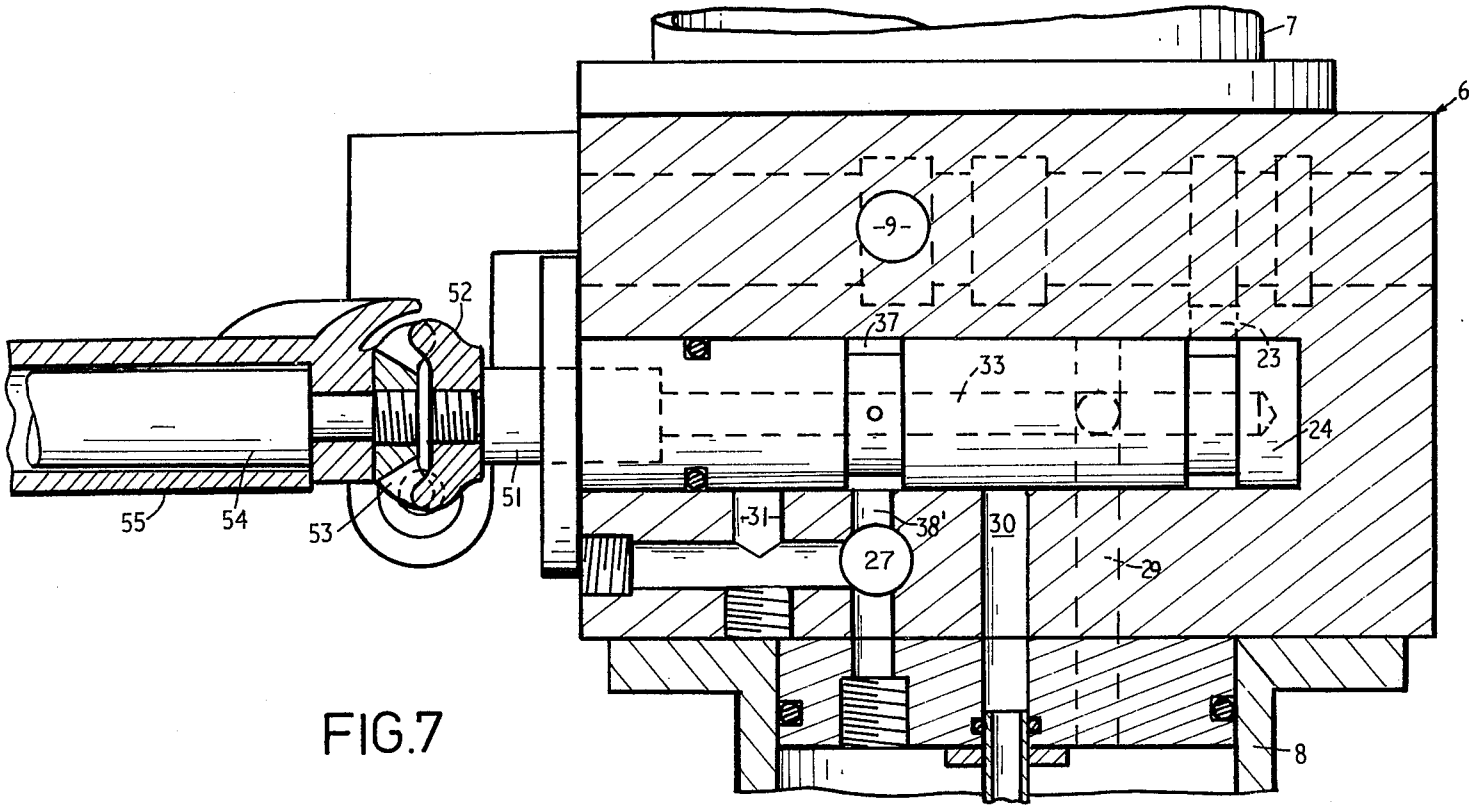
FIG. 7 is a fragmental part sectional elevation of a valve block assembly constructed in accordance with the invention.

The fluid inlet passage 9 has a second smaller passage 16 branching off from it, which communicates with a restrictor assembly 17, which in turn communicates with a third passage 18 entering into a chamber 19 in which the spring 15 is mounted. The valve spool assembly 13 is positioned in such a manner that a fluid supply entering the inlet port 9 will enter a portion 20 of the valve chamber where it meets a resistance to cause a pressure build-up, which in turn causes the fluid to flow through the second smaller passage 16 of inlet passage 19 towards the restrictor 17. The pressure drop across the restrictor 17 at this instant is high because all the fluid is attempting to pass through its orifice 17'. The configuration of the restrictor is such that a proportion of the fluid flowing into the inlet port 9 is permitted to enter the spring chamber 19. This proportion will be according to requirements, but for ease of description would be approximately 5 gallons per minute. The pressure drop across the restrictor 17 causes a corresponding pressure rise in the inlet passage 9. This pressure rise will be apparent in an annulus 20 at the piloted end 12 of the valve spool 14. This pressure increase will act through the pilot passage 11 and against the end 12 of the valve spool 14 to move it axially against the spring pressure, thereby permitting the majority of the fluid to flow from the annulus 20 into a fourth passage 21 which communicates with a first function valve 22. The fluid passing across the restrictor 17 via the third passage 18 into the spring chamber 19 continues through a fifth passage 23 (FIG. 7) to a second function valve 24.

The restrictor may have a fixed size orifice 17' or if required it may be adjustable as shown in FIG. 4.

The first function valve 22, which is also a pressure balanced spool type valve, is adapted to move axially within its housing so that it may direct the fluid pressure flow from the fourth passage 21 to pass into a sixth passage 25 and or a seventh passage 26, according to the position in which it has been set.

The sixth passage 25 returns the fluid to tank via passage 27 (FIG. 3) thus placing no demand on its power. Axial movement of the valve however will close off passage 25 and cause the fluid to be fed to the seventh passage 26 from where it is supplied to the motor 7 or a like device. The configuration of the first function valve 22 and its chamber is such that when it is in a first position and the fluid supply is returned to tank through the passage 27, the motor 7 or like device may be rotated by hand. This is achieved by providing a portion 28 of the valve with a clearance which will interconnect passages 21, 25 and 26 to provide no resistance to the fluid flow to the tank from the function valve, thus providing no substantial resistance to manual rotation of the motor 7.

The flow dividing device 13 is adapted so that any variation in pressure experienced in the region of the passage 16 will be automatically compensated for to maintain the individual, preselected flows at their selected volumetric ratio. The restrictor orifice 17' between the passage 16 and third passage 18 may of course be adjustable so that the volumetric capacity of the flow passing through the spring chamber 19 may be pre-selected according to requirements for a particular situation.

Figure 6:
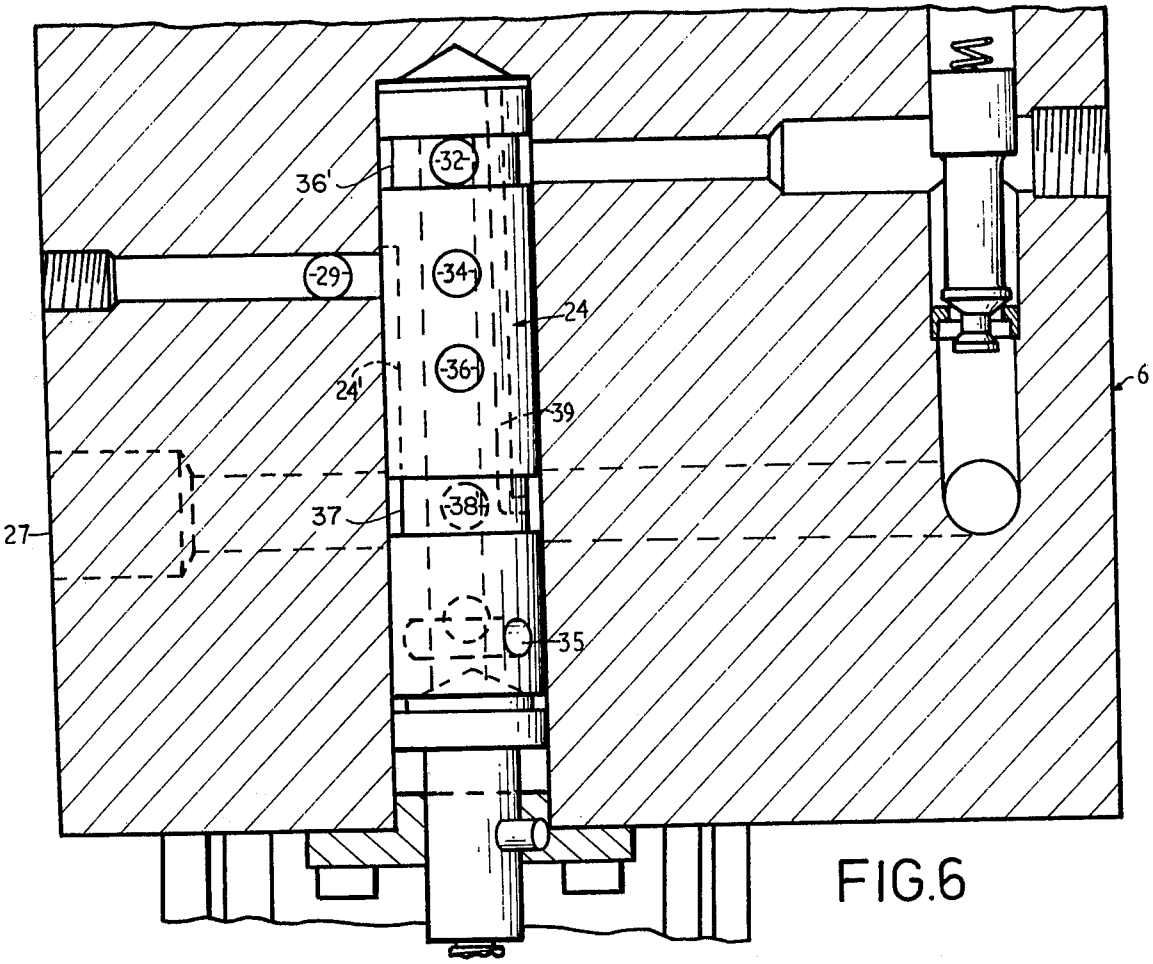
FIG. 6 is a view taken on line 6—6 of FIG. 1.

The fluid passing from the spring chamber 19 to the second function valve 24 (FIGS. 6 and 7) which is a rotary valve, may, by selective operation of that valve, be directed to one of three passages 29, 30 or 31. Rotational movement of the second function valve 24 (FIGS. 6 and 7) to a first position will divert the fluid from passage 23 through an aperture 32 (FIG. 6) in the wall of the valve 24 into an internal passage 33 (FIG. 7) and thence through a second aperture 34 (FIG. 6) into the passage 29 to extend the leg 8. Movement of the valve to a second or null position will close off aperture 34 and pass the fluid through aperture 35 and passage 31 back to tank while closing off passages 29 and 30 thereby locking the leg in its immediate position.

Rotational movement of valve 24 to a third position will close off apertures 34 and 35 and move a third aperture 36 into communication with passage 30.

The second position of the second function valve 24 is the null position in which the fluid is diverted through passage 27 to tank. The third position of valve 24 in effect causes the leg to retract. Because hydraulic pressure is required to both extend and retract the leg the rotary valve is arranged so that the passages 29 or 30 are ported across to passage 27 via slot 24' at the appropriate positions to permit exhausted fluid to be dumped to tank.

The portion 36' of the valve 24 in the region of the passage 32 is reduced in diameter to ensure that fluid may flow through the valve regardless of its rotational position.

To prevent pressure induced axial locking of the valve 24 in any position a second reduced portion 37 (FIG. 6) is provided which communicates with passage 38' which in turn connects with passage 31 and a bleed passage 39 passing axially through the valve 24 connects portion 37 with the end of the spool. This arrangement provides a bleed back to tank thereby eliminating the hydro-lock phenomena.

The various high pressure passages in the body may be provided with relief valves as required.

To avoid damage to the leg 8 one such relief valve 40 (FIG. 5) is interposed between the high pressure supply passage 23 and passage 27. This valve 40 comprises a seat 41 disposed in an ancillary passage 42 between passages 23 and 27. Also disposed in passage 42 is a piston type valve member 43 which is biased towards the seat 41 by spring 44 so that the valve head 45 will normally tend to engage the seat 41.

The valve member 43 has a bleed passage 46' passing through it to permit high pressure fluid to pass therethrough and react on the opposite end face of the member to urge it against the seat 41. Thus as long as the fluid pressure on either side of the valve is equal the spring 44 will urge the valve head 45 into engagement with the seat 41 and prevent the fluid supply present in passage 23 from being diverted to passage 27. A bleed passage 46 connects the ancillary passage 42 to passage 38 (FIG. 5) and provides the means by which valve member 43 may be actuated. Disposed in the passage 46 is a poppet valve 47 and valve seat 48. The valve 47 is urged onto the seat 48 by a spring 49 the compressive load of which is adjustable by means of adjusting screw 50. The valve 47 is preset by means of spring 49 to a condition whereby as long as the pressure of the fluid in bleed passage 46 does not rise above a preselected pressure the valve member 43 will remain closed. If, however, the fluid pressure in passage 46 rises to a value above the preset value of the spring 49, the valve 47 will open allowing fluid in passage 46 to pass into passage 38 thereby causing a pressure drop at the rear end of valve 43 causing it to move to the open position and allow fluid to pass from passage 23 into passage 27. When the pressure in passage 46 drops below the preset value of spring 49, the valve 47 will close and reverse the unbalanced condition of valve 43 whereby pressure build up in the region of passage 46 will cause the valve 43 to close off the seat 41.

Figure 5:
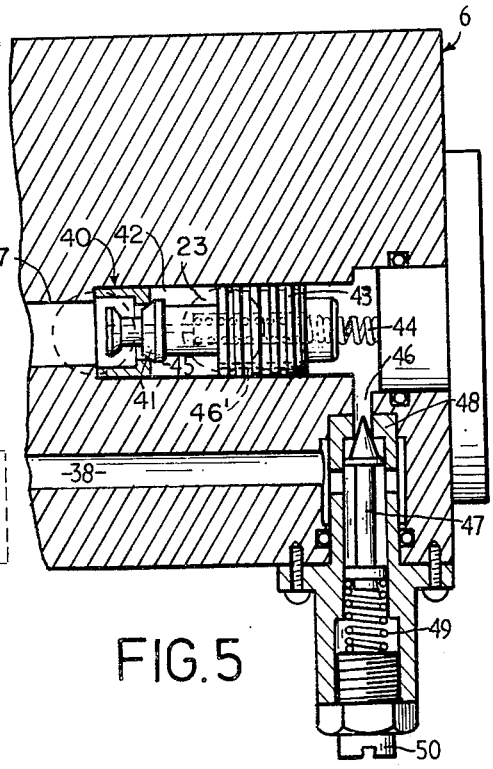
FIG. 5 is a sectional illustration of the area contained by the broken line X in FIG. 1.

A pilot operated balanced piston type relief valve of the type shown in FIG. 5 provides pressure relief at substantially the preset pressure. It may, however, in some circumstances be desirable to provide progressive relief. This may be done by omitting passage 46 and substituting a poppet type valve for the piston type valve member 43. This poppet type valve may be similar in shape to pilot valve 47.

Rotation of the valve 24 is achieved by means of a spigot 51 (FIG. 7) to which is attached a first bevel gear 52 which is in turn meshed with a second bevel gear 53. The second bevel gear 53 is secured to a shaft 54 which is rotatably mounted in a control arm 55 which is pivotally connected to a bracket 56 attached to body 6. The opposite end of the shaft 54 is connected to a handle 57 (FIG. 1) which is held in the operator's hand during use and permits the operator to control the leg 8.

The radial passages 34 and 36 in the rotary valve 24 may be disposed at circumferentially different positions in the valve or the passages 29 and 30 may be offset to each other to ensure that the high pressure oil is directed to only one passage 29 or 30 accordingly.

As may be seen from FIG. 4 the first function valve 22 is biased in one direction by a spring 58 and moved in the opposite direction by a cable control 59. The spring 58 in effect urges spool portion 60 into a position where passages 21, 26 and 25 are interconnected. The cable control 59 is connected by a bowden cable 61 to a lever 62 mounted on the control arm 55 adjacent the control handle 57 thereby providing a compact simple manual control device.

The drill motor 7 (FIG. 1) may be a conventional hydraulic motor fitted with a chuck 63 adapted to receive fixedly therein a drill (not shown). The fluid supply to the motor 7 is transmitted through passage 26 and conduit 64 (FIG. 1) into the inlet of the motor 7. The exhaust fluid from the motor 7 passes through conduit 65 to passage 25 (FIG. 4) and back to tank through passage 27.

Although the apparatus has hereinbefore been described in conjunction with a known type of telescopic leg 8 (FIG. 1) it may also be used in conjunction with the new and improved leg 8′ of FIG. 2. This leg 8′ comprises an outer or main leg member 66 which includes a flanged portion 67 adapted for attachment to the body 6. To the bottom of the main leg member 66 is fitted an annular cap 68 which serves as a guide and sealing member for an intermediate leg member 69. Conventional cylinder seals 70 are used to ensure that fluid does not seep between members 68 and 69.

The intermediate leg member 69 is provided at its upper or inner end 71 with a pair of axially spaced radial flanges 72 which function to maintain the member 69 coaxial to the main member 66. The space 73 between these flanges 72 may, if required, be utilized for a packing ring or gland (not shown). The distance the intermediate member 69 may extend from the member 66 is limited by the provision of a stop member 74 which is secured to the outer surface of member 69 at a position axially spaced from the flanges 72.

The lower or outer end of the intermediate member 69 is also fitted with an annular cap 75 which is provided with a radial flange 76 which acts as a limit stop. The cap 75 also acts as a guide and sealing member for a secondary leg 77 which comprises a tubular member 78. Fluid seepage between the tubular member 78 and cap 76 is prevented by seals 79 while the member 78 is maintained coaxially relative to member 69 by a cap 80 mounted at its upper end. Fluid seepage between the cap 80 and member 69 is again prevented by seals 81 while the lower end of member 77 is closed off by a foot plate member 82. As with member 69 the member 77 is provided with limit stops 83 and 84. The purpose of limits stops 74 and 83 is to prevent the members 69 and 77 from extending sufficiently to expose the transfer passages 91 and 92 to atmosphere thereby preventing retraction of the leg.

Disposed within the tubular member 78 is a further tubular member 85 which passes through a passage in cap 80 and is secured at its upper end in a stepped passage in cap 80, 80′, which is arranged slidably on the tube 88. The lower end of the tube 85 terminates some distance from the foot plate member 82 and is located coaxially within member 78 by an annular ring 86 having passages 87 passing through it. Located within the tube 85 is a supply tube 88 which communicates at its upper end with passage 30 in the body 6 (FIG. 3). Seal rings 89 and 90 once again prevent unwanted oil seepage between the cap 80 and the members 85 and 88.

In use, the rotary valve 24 is moved to the appropriate position causing high pressure fluid to flow through the passage 29 into member 66. This fluid will react against the 71 and 40′ to move both members 69 and 77 outwardly relative to member 8′. When the limit stop 74 engages cap 68, member 69 will cease moving while member 77 will continue to move until limit stop 83 abuts the inner end of end cap 76. Thus, the roof or rock drill may be placed in a tunnel with the plate 82 on the floor and the second functional valve 24 operated to cause the leg 8 to extend until the drill bit 63 abuts the roof of the tunnel. The first functional control valve 24 is then operated to cause the drill bit 63 to rotate whilst the pressure is still applied to the leg 8′ to force the drill into the roof. When the hole in the roof has been drilled to the required depth, the second functional control valve 24 is operated to close off the fluid pressure supply to the passage 29 and divert it through the passage 30 to cause the leg 8 to retract. As the leg is retracted the fluid is forced from the leg through passage 29, from where it is returned to tank via passage 27.

What I claim is:

1. A fluid control mechanism comprising a housing body, a high pressure fluid inlet passage in the body communicating with a priority flow dividing device in the body, including means compensating for fluid pressure and flow variations, said flow dividing device functioning to separate a fluid passing therethrough from the inlet passage into two volumetrically different flow paths, the first one of said flow paths being directed to a first balanced fluid control device adapted to supply a metered fluid flow to a first remote fluid powered device, and another of said flow paths being directed to a second fluid control device adapted to supply a controlled fluid flow through one of a plurality of passages in the body to a second remote fluid powered device for functional control thereof, and wherein said priority flow dividing device comprises a cylindrical chamber (19) formed within said body, a first passage (21) connecting said chamber to said first balanced fluid control device (22), a second passage (23) spaced from said first passage and connecting said chamber to said second fluid control device (24), a third passage (9) connecting said fluid inlet to said chamber at a point intermediate said first passage (21) and one end of said chamber and a fourth passage connecting said inlet with said chamber at a point intermediate said second passage (23) and the opposite end of said chamber, a pressure balanced spool valve (14) disposed slidably within said chamber and including a first portion at least partly closing off at least said second passage (23), said spool valve (14) including a second portion disposed between said one end of said chamber and said third passage and connected to said first portion by a spindle disposed in the region of said third passage, said second portion of said valve including pressure bleed means (11) permitting fluid to enter the area (12) between said one end of the chamber and the adjacent end face of said second valve portion, said flow dividing device (13) further including resilient means (15) biasing said spool valve towards said one end of said chamber.

2. A fluid control mechanism as in claim 1 including a variable restrictor disposed in said fourth passage.

3. A fluid control mechanism as in claim 1 wherein the cross sectional area of said fourth passage is less than the cross sectional area of said third passage.

4. A fluid control mechanism as in claim 3 including a variable restrictor disposed in said fourth passage.

5. A fluid control mechanism as in claim 4 wherein said first passage communicates with a second chamber at a point intermediate its ends and wherein said first fluid control device comprises a second pressure balanced spool valve mounted in said second chamber and biased by resilient means towards a first position in which high pressure fluid passing from said first passage passes through said chamber to a fifth passage to return to tank via a fluid return passage, said mechanism further including means adapted to move said second spool valve axially towards a second position to close off said fifth passage and divert said fluid supply through a sixth passage to said first fluid powered device, the exhaust fluid from said first fluid powered device returning via a conduit and said fifth passage to tank.

6. A fluid control mechanism as in claim 5 wherein said second fluid control device comprises a rotary valve mounted in a chamber within said body, said valve having a first circumferential groove communicating with said second passage, said groove having an aperture therein connecting said groove to an axial passage extending through said valve, said axial passage being closed off at each end, said rotary valve having a radial passage spaced from said first groove and adapted to connect with a fluid outlet to said second fluid powered device when said rotary valve is moved to a first position, exhaust fluid from said second fluid powered device being returned via a return passage which, when said rotary valve is in said first position, is connected by an axial slot in said valve with said fifth passage, said rotary valve having a second radial passage communicating with said axial passage and adapted to connect said return passage with said second passage when said rotary valve is moved to a second position whereby the direction of operation of said second fluid powered device is reversed, said axial slot connecting said fluid outlet with said fifth passage when said rotary valve is in said second position, said mechanism further including relief valve means disposed in said second passage and adapted to connect said second passage with said fifth passage when the pressure of a fluid supply to said second fluid powered device exceeds a predetermined pressure.

7. A fluid control mechanism as in claim 6 wherein said rotary valve is selectable to a third position whereby a third radial aperture connects said axial passage with said fifth passage to divert said fluid supply to tank.

8. A fluid control mechanism as in claim 7 wherein said relief valve is a pilot operated pressure balanced valve.

9. A fluid control mechanism as in claim 8 wherein said relief valve comprises a fourth chamber communicating at one end with said second passage, said fifth passage communicating with said fourth chamber at a point intermediate its ends, a valve seat disposed within said fourth chamber intermediate said second and fifth passages, a piston valve disposed in said chamber and biased towards said seat by a spring, a bleed passage passing coaxially through said piston valve to permit fluid to pass through said piston valve to maintain an equal fluid pressure at each end thereof, the area between the end of said fourth chamber remote from said second passage and the adjacent end of said piston valve being connected to said fifth passage by a pilot passage, said pilot passage being closed off by a spring biased pilot valve.

10. A fluid control mechanism as in claim 9 wherein said rotary valve includes means preventing axial hydraulic locking thereof, said means comprising a bleed passage connecting the inner end of the third chamber with a second circumferential slot spaced from the first circumferential slot and communicating with said fifth passage.

11. A fluid control mechanism comprising a housing body, a high pressure fluid inlet passage in the body communicating with a priority flow dividing device in the body, including means compensating for fluid pressure and flow variations, said flow dividing device functioning to separate a fluid passing therethrough from the inlet passage into two volumetrically different flow paths, the first one of said flow paths being directed to a first balanced fluid control device adapted to supply a metered fluid flow to a first remote fluid powered device, and another of said flow paths being directed to a second fluid control device adapted to supply a controlled fluid flow through one of a plurality of passages in the body to a second remote fluid powered device for functional control thereof, wherein said second fluid powered device comprises a telescopic leg arranged and disposed to move said first fluid powered device progressively between a first position and a second position, the speed of movement thereof being automatically controlled with respect to the operational speed of said second fluid powered device; said leg comprising first, second and third tubular members disposed coaxially one within the other; said second and third members including means defining a plurality of fluid reaction faces, said leg further including a first fluid supply and return passage adapted to be connected to one of said plurality of passages in said body whereby fluid from said second fluid control device may be directed to a first series of said faces to axially extend said leg, and a second fluid supply and return passage connected at one end to another of said plurality of passages in said body, the opposite end of said second fluid supply and return passage extending coaxially into said leg to supply fluid from said second fluid control device to a second series of said faces to retract said leg.

* * * * *